US006786184B2

(12) United States Patent
Oh

(10) Patent No.: US 6,786,184 B2
(45) Date of Patent: Sep. 7, 2004

(54) MIDDLE DECK OF CYLINDER HEAD

(75) Inventor: Chang-Seok Oh, Kyungki-Do (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 10/308,977

(22) Filed: Dec. 3, 2002

(65) Prior Publication Data

US 2003/0221642 A1 Dec. 4, 2003

(30) Foreign Application Priority Data

May 28, 2002 (KR) ..... 2002-29565

(51) Int. Cl.[7] ..... F02F 1/36

(52) U.S. Cl. ..... 123/41.82 R

(58) Field of Search ..... 123/196 R, 41.44, 123/41.74, 41.1, 195 R, 41.82 R, 41.69, 41.72, 41.75, 41.76, 196 M, 196 AB, 90.33

(56) References Cited

U.S. PATENT DOCUMENTS

| | | | | |
|---|---|---|---|---|
| 4,630,580 | A | 12/1986 | Sawaki et al. | |
| 4,644,910 | A | 2/1987 | Kawamura | |
| 4,688,524 | A | 8/1987 | Takahashi | |
| 4,889,079 | A | 12/1989 | Takeda et al. | |
| 5,207,197 | A | 5/1993 | Klingmann et al. | |
| 5,983,844 | A | 11/1999 | Hauder | |
| 6,202,603 | B1 | 3/2001 | Etemad | |
| 6,530,356 | B2 * | 3/2003 | Inoue et al. | 123/196 R |

* cited by examiner

*Primary Examiner*—Tony M. Argenbright
*Assistant Examiner*—Hyder Ali
(74) *Attorney, Agent, or Firm*—Morgan Lewis & Bockius LLP

(57) ABSTRACT

A middle deck of a cylinder head having a partition that separates the exhaust and suction sides thereof to make the engine oil flow longer at the exhaust side having a greater area adjacent to a water jacket and cool off to a required level of temperature by enlarging the radiation area with a plurality of radiation protruders.

13 Claims, 2 Drawing Sheets

MIDDLE DECK OF CYLINDER HEAD

FIELD OF THE INVENTION

The present invention relates to a cylinder head of an engine, and more particularly, to a middle deck of a cylinder head that is adapted to efficiently cool engine oil.

BACKGROUND OF THE INVENTION

In general, a water jacket is formed at a lower portion and an upper side of a middle deck of a cylinder head. The water jacket formed at a lower portion is used for cooling off an upper part of an engine's combustion chambers. The water jacket formed at the upper side is used for cooling lubrication oil and a cam shaft and suction/exhaust valves, thereby letting hot engine oil flow, cool down lubrication oil and drain into an oil pan. Cooling is performed by a heat-exchange process.

Generally, a cylinder head is divided between upper and lower portions by a middle deck. Engine oil used to lubricate the camshaft and valves flows through the upper portion, while a water jacket is provided below the middle deck to act as a heat-exchanger. Various holes are formed through the middle deck for receiving spark plugs, etc.

The water jacket is normally located mostly on an exhaust side of the cylinder head as the exhaust side operates at a highter temperature, and, therefore, requires more cooling. The middle deck is generally a sloped planar surface, sloping down from the exhaust side of the cylinder head to an intake side.

However, the conventional structure of the middle deck (M) has drawbacks, as engine oil does not remain at the exhaust side long enough to effectively cool the engine oil as it flows down the sloped surface of the middle deck (M) downward toward the intake side.

SUMMARY OF THE INVENTION

The present invention provides a middle deck of a cylinder head that reduces the temperature of engine oil by heat-exchanging the engine oil flowing at the middle deck with cooling water flowing along a water jacket under the middle deck.

In accordance with an embodiment of the present invention, a partition is coupled to the the middle deck between an intake and exhaust side of a cylinder head. In addition, a plurality of radiating protruders are formed on the surface of the middle deck for enlarging the heat exchange contact area above the middle deck.

According to a further preferred embodiment of the invention there is provided a cylinder head with an exhaust side and an intake side opposite the exhaust side. The cylinder head also includes a middle deck separating a lower portion from an upper portion of the cylinder head. The middle deck is sloped from the exhaust side to the intake side. At least one partition is coupled to the middle deck in the upper portion. The at least one partition at least partially seperates the upper portion between the exhaust side and the intake side. The cylinder head also preferably includes at least one radiating protruder coupled to the middle deck in the upper portion. The radiating protruder is configured to increase a heat exchange surface area in the upper portion. In a preferred embodiment, radiating protruders are provided on both the exhaust and intake sides. These radiating protruders preferably have different shapes. Also, at least one boss extends through the middle deck for receiving a spark plug. A water jacket is disposed in the lower portion, preferably on the exhaust side. A portion without any partitions is located between at least two partitions, such as between two middle bosses for receiving spark plugs.

BRIEF DESCRIPTION OF THE DRAWINGS

For fuller understanding of the nature and objects of the invention, reference should be made to the following detailed description taken in conjunction with the accompanying drawings in which.

DETAILED DESCRIPTION OF THE INVENTION

Figure 1:
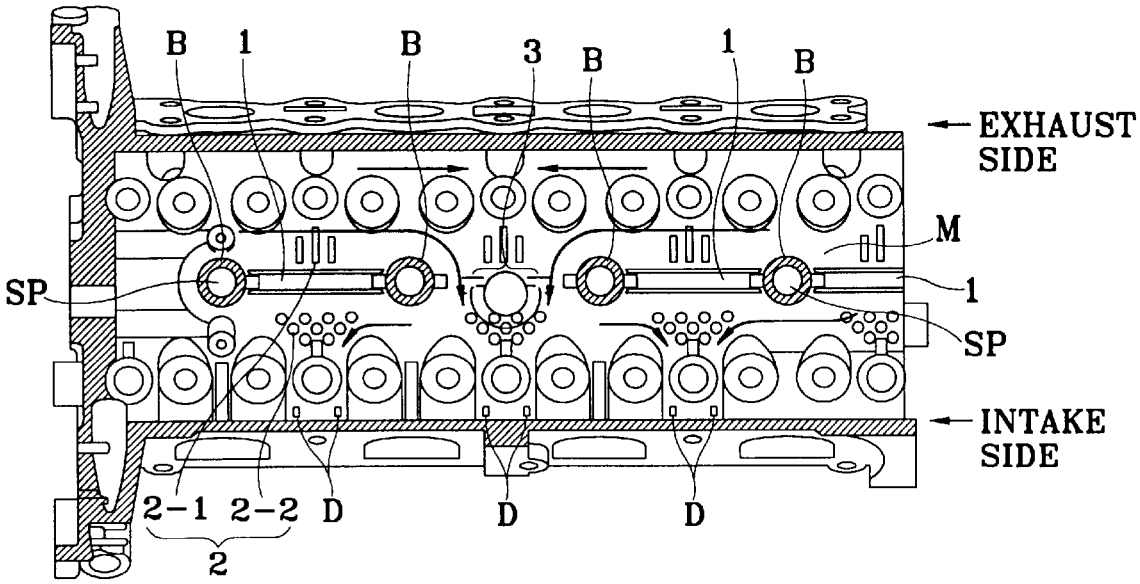
FIG. 1 illustrates a middle deck of a cylinder head in accordance with the present invention.
Figure 2:
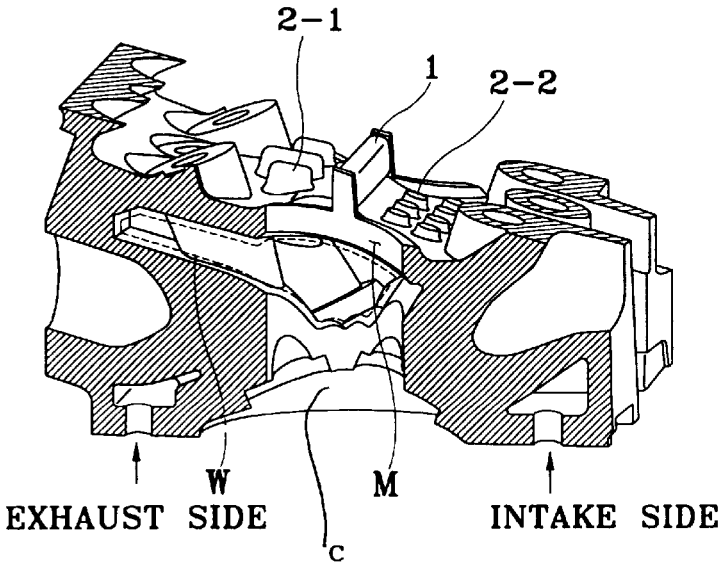
FIG. 2 illustrates the portion of the middle deck shown in FIG. 1 as it is seen at a different angle.
Figure 3:
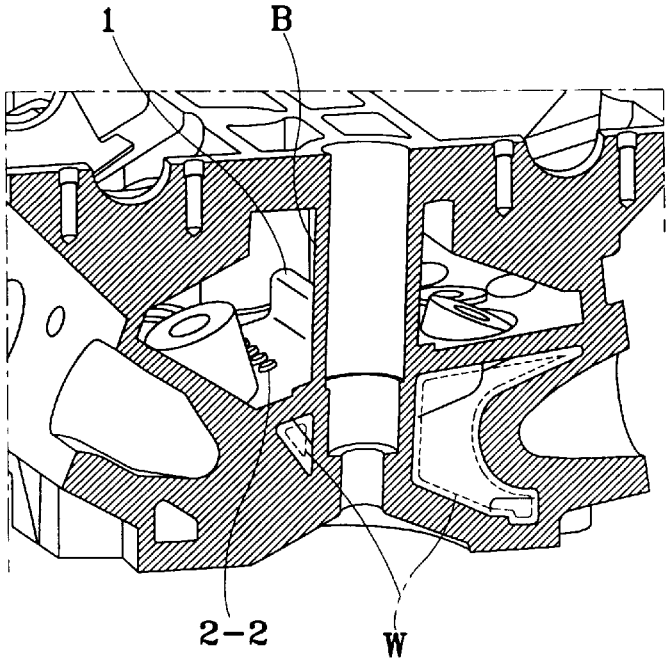
FIG. 3 is a vertical cross-sectional view of a cylinder head having a middle deck at the center of a combustion chamber.
Figure 4:
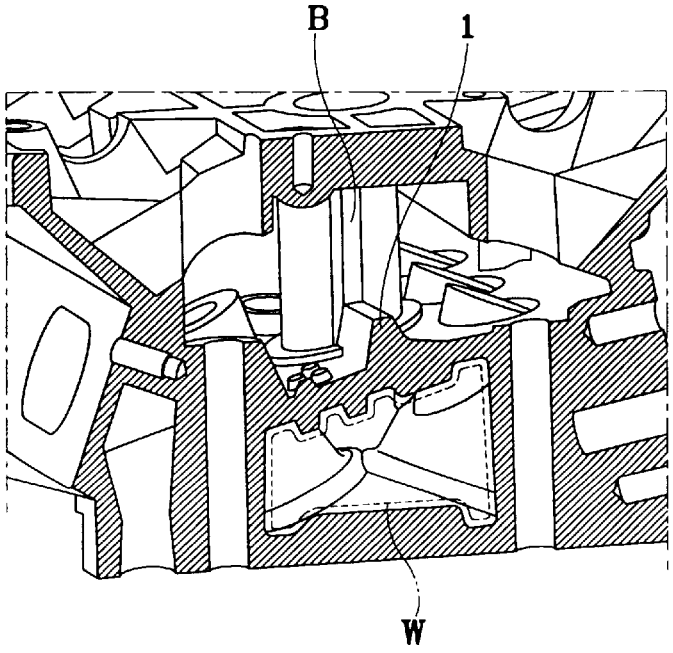
FIG. 4 is a vertical cross-sectional view of a cylinder head having a middle deck between combustion chambers.

FIGS. 1 and 2 show an upper portion of a combustion chamber (C) formed at a lower end of a cylinder head. Spaces (SP) are formed for insertion of a spark plug and a water jacket (W) is formed at the upper side of the combustion chambers. The upper portion of the water jacket (W) is defined by the middle deck (M). The engine oil used to lubricate the cam shaft and valves flows at the upper portion of the middle deck (M).

The water jacket (W) occupies a greater space on the exhaust side than the intake side, so that the high temperature of exhaust gas is more effectively cooled at the exhaust side. Therefore, the middle deck (M) is formed with an exhaust side that has a large contact area with the water jacket. The middle deck (M) is sloped from the exhaust side to the intake side for collecting and draining the engine oil.

Partitions (1) separate the upper portion between the intake and exhaust sides of a middle deck (M). A plurality of radiating protrusions (2) are formed on the upper surface of the middle deck for increasing the heat exchange area. The partition (1) is disposed between bosses (B) formed for receiving spark plugs for the respective combustion chambers. Also, the partitions (1) have a height high enough so that the engine oil flows along and over the partition (1) from the exhaust side to the intake side, while a certain amount of the engine oil constantly remains on the exhaust side of the partition (1). The partition (1) allows engine oil introduced into the upper portion on the exhaust side, to remain in contact with the water jacket long enough to effectively be cooled by the cooling water flowing within the water jacket formed under the middle deck.

A portion without any partitions (3) is formed to allow some engine oil to flow along the partitions (1) to be efficiently cooled by the cooling water flowing under the middle deck (M) (see arrows in FIG. 1). The portion without any partitions (3) is formed between the two central spark plug bosses. However, this portion (3) may be formed at any other suitable position depending upon the installation position of the oil drain hole (D) for draining the engine oil out to the oil pan. This portion (3) may also be more or less varied in size and shape.

The radiating protrusions (2) preferably have different shapes at the intake and exhaust sides of the middle deck, and may be installed on either the suction or exhaust side of the middle deck (M). In a preferred embodiment of the present invention, a plurality of short, straight radiating protruders (2-1) are formed at the exhaust side of the middle deck (M) and a plurality of circular radiating protruders (2—2) are formed at the suction side of the middle deck (M).

When the engine oil for lubricating and cooling the cam shaft and valves is introduced into the upper portion of the middle deck (M), the engine oil introduced into the exhaust side of the middle deck (M) cannot flow directly to the suction side because of the partition (1). Some of the oil is stopped by the partition (1) and then flows along and over the partition (1) to the suction side. Other engine oil flows to the portion without any partitions (3) without being stopped by the partition (1) and exchanges heat with the cooling water flowing within the water jacket (W) under the middle deck (M).

The radiating protruders (2) are formed to enlarge a contact area between the engine oil and the middle deck (M) for more effectively exchanging heat and cooling off the engine oil with the cooling water flowing within the water jacket (W), thereby making it possible to reduce the engine oil to a desired temperature.

As described above, there is an advantage in the middle deck of the present invention in that the engine oil is made to flow for a longer time at the exhaust side of the middle deck having a greater area adjacent to the water jacket. This effectively cools the engine oil to a desired temperature by increasing the heat-exchange contact area using a plurality of radiation protruders (2).

What is claimed is:

1. A middle deck of a cylinder head, comprising:

a partition coupled to a side of said middle deck remote from a combustion chamber, wherein said partition has a height and divides an exhaust side of said cylinder head from and intake side of said cylinder head;

a portion without any partitions on said side of said middle deck, where said portion without any partitions is used to control the flow of engine oil from said exhaust side to said intake side; and a plurality of radiating protruders formed on the surface of said middle deck, effectively enlarging a heat-exchange area.

2. The middle deck as defined in claim 1, further comprising bosses formed through said middle deck or installation of spark plugs for respective combustion chambers.

3. The middle deck as defined in claim 1, wherein said portion without any partitions is installed between two middle bosses formed for installation of spark plugs.

4. The middle deck as defined in claim 1, wherein said radiating protruders are formed with different shapes at the intake side and at the exhaust side.

5. A cylinder head, comprising:

an exhaust side;

an intake side opposite said exhaust side;

a middle deck separating a lower portion from an upper portion of said cylinder head, where said middle deck is sloped from said exhaust side to said intake side;

at least one partition coupled to said middle deck in said upper portion, where said at least one partition at least partially seperates said upper portion between said exhaust side and said intake side; and a portion without any partitions between at least two partitions.

6. The cylinder head of claim 5, further comprising at least one radiating protruder coupled to said middle deck in said upper portion, where said radiating protruder is configured to increase a heat exchange surface area in said upper portion.

7. The cylinder head of claim 5, further comprising at least one boss extending through said middle deck for receiving a spark plug.

8. The cylinder head of claim 5, further comprising a water jacket in said lower portion.

9. The cylinder head of claim 8, wherein said water jacket is located on said exhaust side.

10. The cylinder head of claim 5, wherein said portion without any partitions is installed between two middle bosses for receiving spark plugs.

11. The cylinder head of claim 5, further comprising radiating protruders coupled to said middle deck in said upper portion on both said exhaust and intake sides, where said radiating protruders on said exhaust side have a different shape to the radiating protruders on said intake side.

12. A middle deck of a cylinder head, said middle deck separating a lower portion of said cylinder head from an upper portion of said cylinder head, where said middle deck is sloped from said exhaust side to said intake side, where said middle deck defines at least one partition in said upper portion that at least partially separates said upper portion between said exhaust side and said intake side, and where said middle deck further defines radiating protruders in said upper portion on both said exhaust and intake sides, where said radiating protruders on said exhaust side have a different shape to said radiating protruders on said intake side.

13. The cylinder head of claim 12, wherein said middle deck further defines at least one radiating protruder coupled to said middle deck in said upper portion, where said radiating protruder is configured to increase a heat exchange surface area in said upper portion.

* * * * *